United States Patent [19]

Murnane, III et al.

[11] Patent Number: 5,067,410

[45] Date of Patent: Nov. 26, 1991

[54] FLEXIBLE WING

[75] Inventors: James F. Murnane, III, Andover; William G. Kuhnle, Hopatcong, both of N.J.

[73] Assignee: The United States of America as represented by the Secretary of the Army, Washington, D.C.

[21] Appl. No.: 632,211

[22] Filed: Dec. 21, 1990

[51] Int. Cl.[5] ..... F42B 10/48; F42C 15/00

[52] U.S. Cl. ..... 102/489; 102/225; 102/388; 102/393; 102/476; 416/240

[58] Field of Search ..... 102/225, 384, 388, 393, 102/476, 489; 244/3.3; 416/144, 240

[56] References Cited

U.S. PATENT DOCUMENTS

| | | | |
|---|---|---|---|
| 3,140,661 | 7/1964 | Clarke | 102/225 |
| 3,273,834 | 9/1966 | Bower | 102/388 |
| 3,913,483 | 10/1975 | Wolterman | 102/476 |
| 4,161,371 | 7/1979 | Sheppa | 102/208 |
| 4,455,940 | 6/1984 | Furuike | 102/489 |
| 4,665,332 | 5/1987 | Meir | 102/208 |
| 4,726,292 | 2/1988 | Gatti | 102/489 |
| 4,756,253 | 7/1988 | Herring et al. | 102/393 |
| 4,762,066 | 8/1988 | Rudenauer et al. | 102/489 |
| 4,986,185 | 1/1991 | Kuhnle et al. | 102/388 |

*Primary Examiner*—Harold J. Tudor

*Attorney, Agent, or Firm*—Anthony T. Lane; Edward Goldberg; Edward F. Constigan

[57] ABSTRACT

A flexible wing which is connected to a submunition provides a substantially vertical descent and provides torque which power submunition electronics. The flexible wing is deployed in a low drag configuration to avoid collision with other submunitions. The flexible wing is canted to allow rotation of the wing.

2 Claims, 5 Drawing Sheets

( SEE FIGURE 1, SECTION A-A)

FLEXIBLE WING

The invention described herein may be manufactured, used and licensed by or for the Government for Governmental purposes without payment to us of any royalties thereon.

BACKGROUND OF THE INVENTION

1. Field of the Invention

The invention is related to the delivery of submunitions which are the payload of artillery projectiles or missiles that are fired from artillery cannons or launched from aircraft or rocket launchers.

Typically, a large number of these submunitions are carried in a projectile or in a missile in order to cover a large area. These submunitions deliver a shaped charge warhead for armor penetration or fragmentation for antipersonnel application.

The submunitions should be delivered with adequate dispersion, with near vertical angle of descent and have proper fuze function upon impact for maximum effectiveness. If no device is used to retard the flight of the submunitions, they will follow a ballistic trajectory, impact with minimal dispersion and impact at high angle with respect to the vertical.

2. Description of the Prior Art

The retarding device of the prior art causes the submunition to impact with high angles with respect to the vertical and causes a deterioration in the submunition's performance or a complete malfunction or dud ("a complete malfunction" is synonymous to "dud"). If the submunition is not substantially vertical upon impact, the depth of penetration of shaped charge or the distance that the lethal fragments are thrown is significantly decreased.

A second problem of the retarding device of the prior art is that the submunition's fuze is purely mechanical and is dependent on impact angle and ground conditions. The dud rate of a given submunition cluster is increased if the angle of impact varies from the vertical or if the submunition strikes relatively soft medium.

A ribbon loop which is attached to the top of the submunition fuze is one such retarding device. However, this ribbon loop provides only marginal flight stability to the submunition when subject to high spin as with an artillery projectile. With a missile, little or no spin is imparted to the submunition, and consequently the ribbon does not provide sufficient pitch damping. The result is unstable submunition flight and oscillation at very high angles. The looped ribbon does not provide means to drive an alternator for an electronic fuze.

To overcome the problem of a mechanical fuze, a rigid rotor can be used to provide flight stability and torque for driving an alternator, but its application to the aforementioned submunitions has several drawbacks. First, because a rigid rotor is, by its very nature, rigid, it is difficult to pack a rigid wing or rotor in a small oddly-shaped volume. Second, the rigid rotor must be stowed in a non-functioning configuration. Therefore, it requires additional mechanical devices, such as springs and clips, in order to deploy it to its flight configuration. Such additional devices complicate the design, cause reliability problems, and are the source of increased costs and difficulties in loading the submunitions into the carrier. Third, the rigid rotor must be designed to withstand high dynamic loading upon deployment without undergoing permanent deformation. A design of such structural integrity is often quite bulky, increases the overall weight of the projectile, and decreases its effective range. Last, as the rigid rotor is deployed, it assumes an immediate high-drag configuration, i.e. it does not have any intermediate configurations which have a lower drag. This behavior, when coupled with the close proximity of dozens of other deploying submunitions, results in very high probability of failure due to submunition-to-submunition collision.

A rotating parachute (such as a vortex ring or rotafoil) can provide excellent flight stability, i.e. low oscillatory motion upon descent, and can provide a limited amount of torque by using a coupling device such as a clutch. However, the clutch adds cost and adds complication to the system. Additionally, deploying parachutes can be subject to line entanglement as well as collision damage. Thus, the parachute needs to be reefed to allow the staggered filling of the parachute, or it requires some type of protective covering during expulsion/ejection from the carrier and a series of timing devices to release the protective covering at different times to ensure proper submunition cluster deployment. The cost and volumetric penalties, in this case, make the rotating parachute unfeasible.

The performance of rotating parachutes is very sensitive to line length and material dimensional tolerances. This sensitivity along with the difficulties associated with the manufacture of a very small parachute make the rotating parachute an extremely costly alternative.

SUMMARY OF THE INVENTION

In view of the above-noted deficiencies in the prior art, the present invention provides a flexible wing which is mounted on a submunition and which stores in a relatively small volume. The flexible wing of the present invention is easily deployed from its carrier with little risk of damage.

The present invention is capable of providing a very stable descent that will have the submunition impacting at angles less than 5 degrees from the vertical and is capable of supplying torque that can be used to drive an alternator during flight for allowing the use of an electronic fuze which is insensitive to impact conditions and which has an extremely low rate of fuze malfunction.

The flexible wing acts as a turbine to provide torque to an alternator which powers electronics in flight. The invention stabilizes the submunition so that it may descend with very small angles with respect to vertical (less than 5 degrees from vertical). By allowing the submunition to utilize an electronic fuze and by allowing it to impact nearly vertical, the flexible wing allows the submunition system to attain very high performance.

BRIEF DESCRIPTION OF THE DRAWINGS

The above and other objects, advantages and features of the invention will be more fully understood when considered in conjunction with the following discussion and the attached drawings, of which.

DESCRIPTION OF THE PREFERRED EMBODIMENT

A submunition is an explosive device which is used as a weapon against both armor and personnel. These submunitions are the cargo of artillery projectiles and of missiles. The projectiles are typically fired from cannons whereas the missiles are usually launched from rocket launchers but can also be dropped from aircraft.

At some predetermined altitude and range from the target, the group of submunitions are ejected or expelled from its carrier. These submunitions descend and strike the target or the ground in the vicinity of the target. The submunition's fuze is then detonated, and the warhead is discharged. The warhead may be an armor penetrating or a fragmentation device.

In order for this weapon system to have high performance, the submunition stack or cluster should have proper dispersion, low dud rate and either high armor penetration or high personnel lethality.

One primary factor affecting submunition system performance is the angle of impact because it influences fuze function, fragmentation spray and warhead depth of penetration. An impact angle as close to vertical as possible is desirable because it reduces the probability of a fuze malfunction and enhances fragmentation spray distance and depth of warhead penetration.

It can be important to include in the submunition a means of fuzing the weapon so that its detonation is independent of the impact medium (i.e. mud, snow, tall grass, branches). Using an electronic fuze instead of a mechanical fuze allows detonation to be independent of impact conditions. An electronic fuze, however, requires a power source. The best way to power a fuze of this type is to use a turbine-alternator arrangement that is driven while the submunition descends. In this way, no battery is necessary, and the source of power remains unchanged over long term storage.

Figure 2:
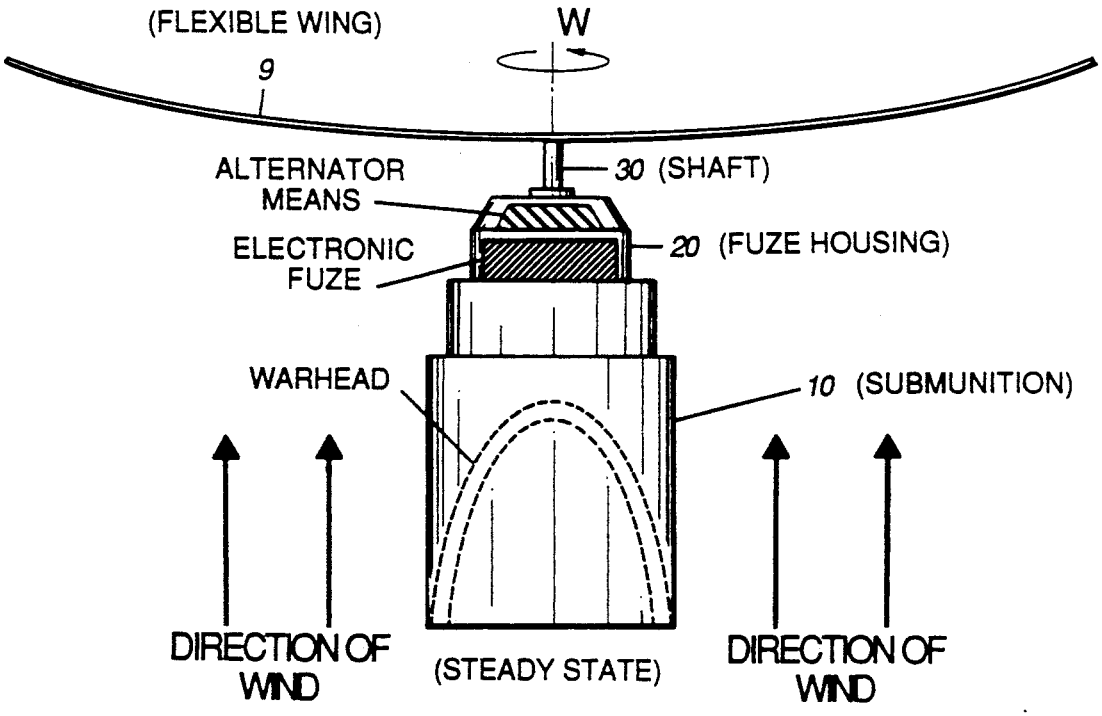
FIG. 2 is a side view of the flexible wing attached to a submunition.

In one embodiment as shown in FIG. 2, rotating flexible wing 9 can be used to generate electric power. Rotating flexible wing 9 is a turbine which turns shaft 30 which in turn drives the alternator (not shown) which is located under fuze housing 20 and which creates electrical power. The alternator can be used as a source of power for fuze electronics (not shown) which is located under fuze housing 20 thereby arming submunition 10.

Flexible wing 9 is a flexible auto-rotating device that is attached to shaft 30 and which stabilizes the submunition to within 5 degrees of vertical and provides the necessary torque to drive an alternator (not shown) in-flight.

Figure 4:
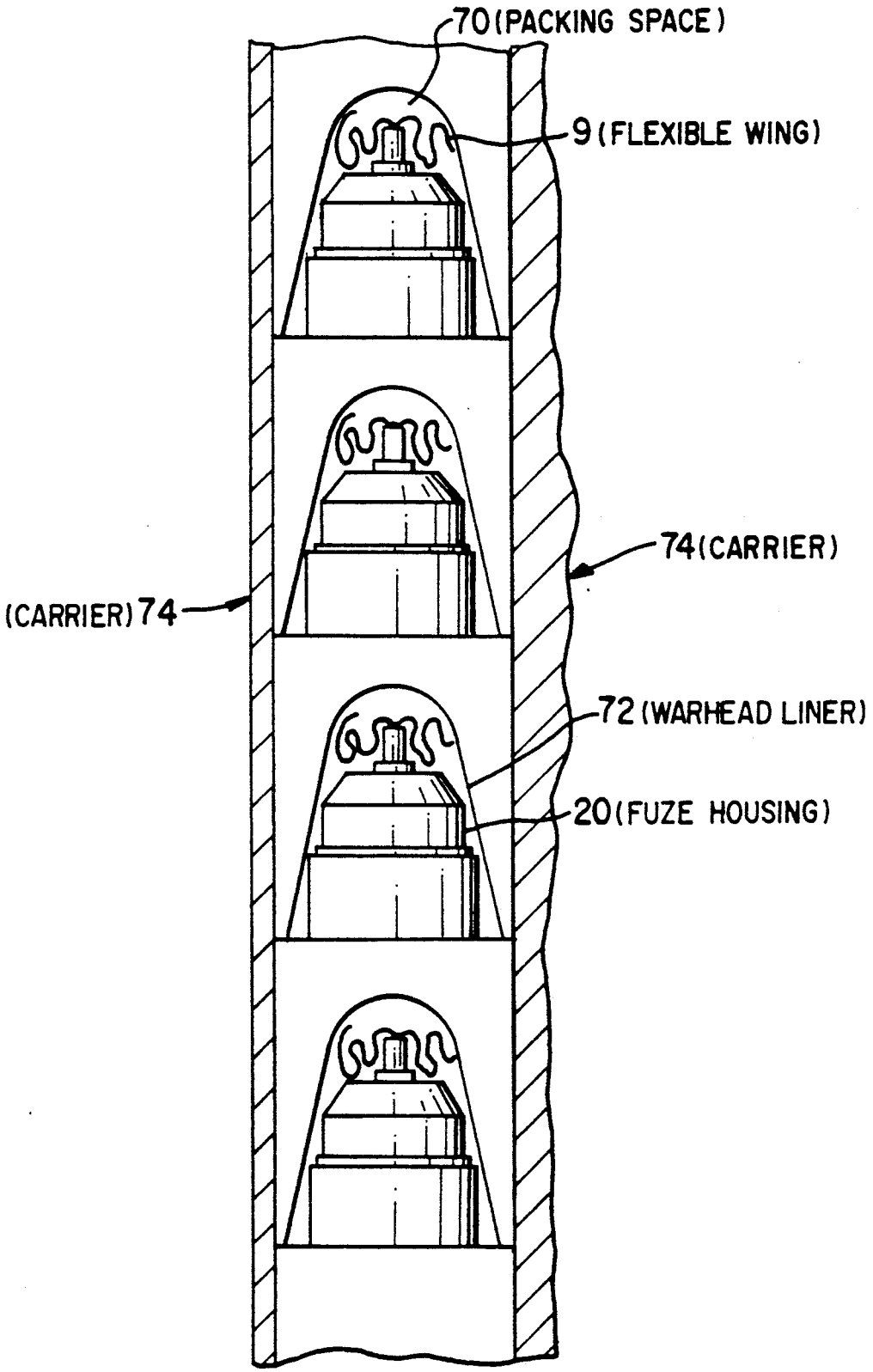
FIG. 4 is a sectional view of a submunition stack and the flexible wing in a stowed configuration.

As shown in FIG. 4, carrier 74 provides an apparatus to deliver multiple submunitions. Submunitions are loaded inside carrier 74 by stacking them on top of one another, i.e., resting the bottom of one submunition on the shoulder of the next submunition. This type of nesting leaves an inner volume 70 which is a small, oddly shaped volume of space between the fuze housing of one submunition 10 and warhead liner 72 of the next submunition. Within inner volume 70, flexible wing 9 is folded and stowed. Because flexible wing 9 is preferably formed from fabric, it can be stowed in a multitude of different packed configurations of very low and/or oddly shaped volumes. The flexible wing's stowed configuration is independent of its deployed or functioning configuration.

Flexible wing 9 is retained and deployed without the use of any additional mechanical devices (for example springs, clips, cables). Flexible wing 9 is retained by nesting the submunitions in carrier 74.

Figure 7:
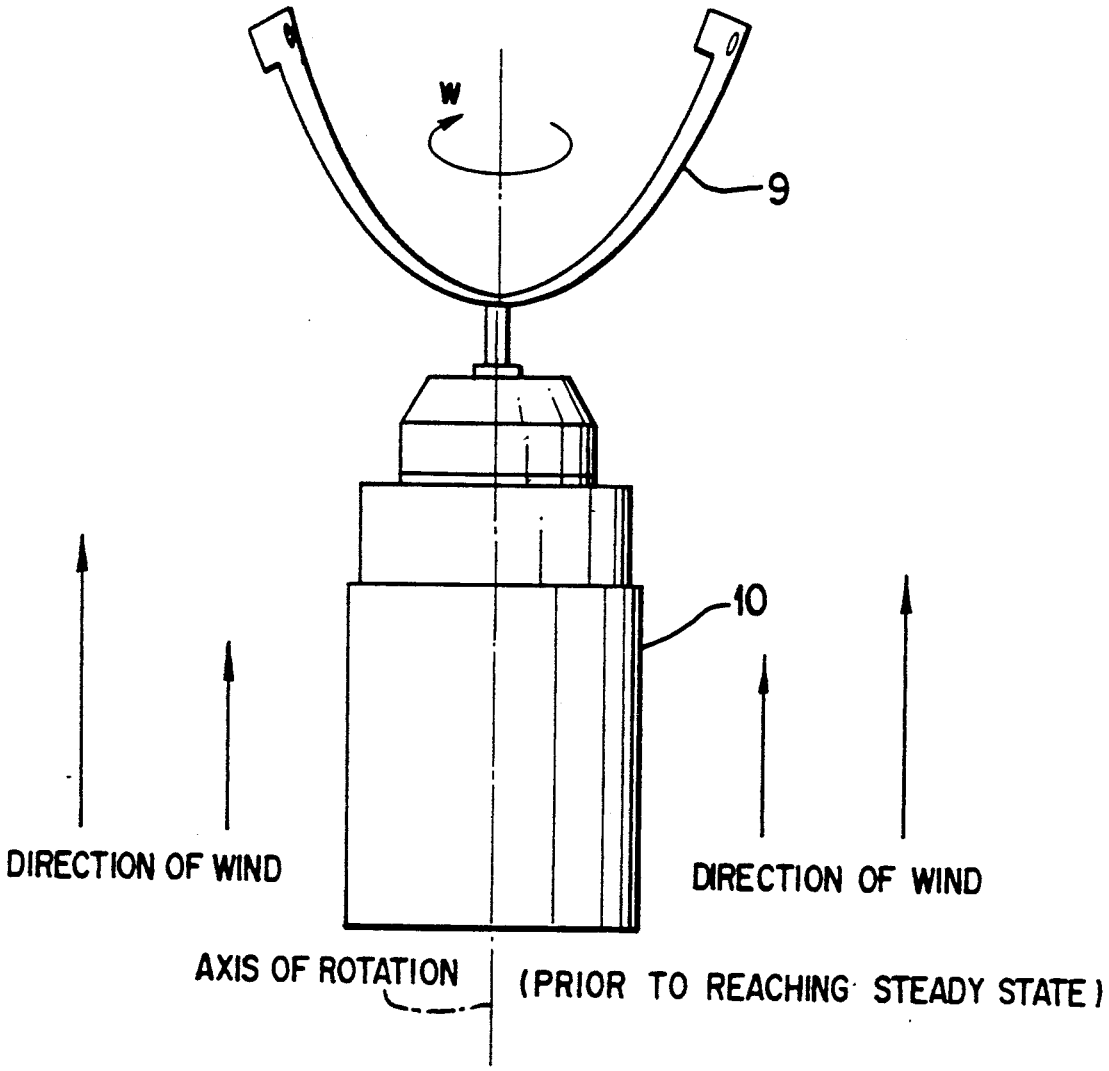
FIGS. 7 is an additional view of the flexible wing.

Aerodynamic and centrifugal forces deploy the flexible wing and determine its shape throughout its flight. As shown in FIG. 7, at high velocities, flexible wing 9 assumes a shape of lower polar moment of inertia than at steady state velocity, where the acceleration of the submunition is zero. Flexible wing 9 at high velocities is forced close to the shaft 30, thus it can sustain higher deployment velocities without damage than its rigid rotor counterpart which cannot be placed as close to its axis of rotation.

As shown in FIG. 7, upon ejection or expulsion from carrier 74, flexible wing 9 initially assumes a low-drag shape, i.e., is positioned close to the axis of rotation. This shape allows for wide dispersion of the cluster of submunitions and insures a low incidence of collision between submunitions. As the submunition slows, the shape of flexible wing 9 emulates a rigid rotor and eventually slows the submunition to obtain a steady state descent velocity and spin rate.

Flexible wing 9 is a flexible fabric rotor made of two identical opposing blades 7. The flexible wing 9 comprises a high strength to weight ratio fabric (for example nylon, "KEVLAR or SPECTRA") of specific stiffness; porosity; thickness; length; width; contour; leading edge tip mass, size and location; and trailing edge flap shape and dimensions. These parameters can be adjusted to change the effective pitch of the flexible wing 9 and thus change the descent rate and/or torque generated by the flexible wing 9.

The performance (stability, descent rate and spin rate) of flexible wing 9 is dependent on the pitch of its blades during flight.

Figure 5:
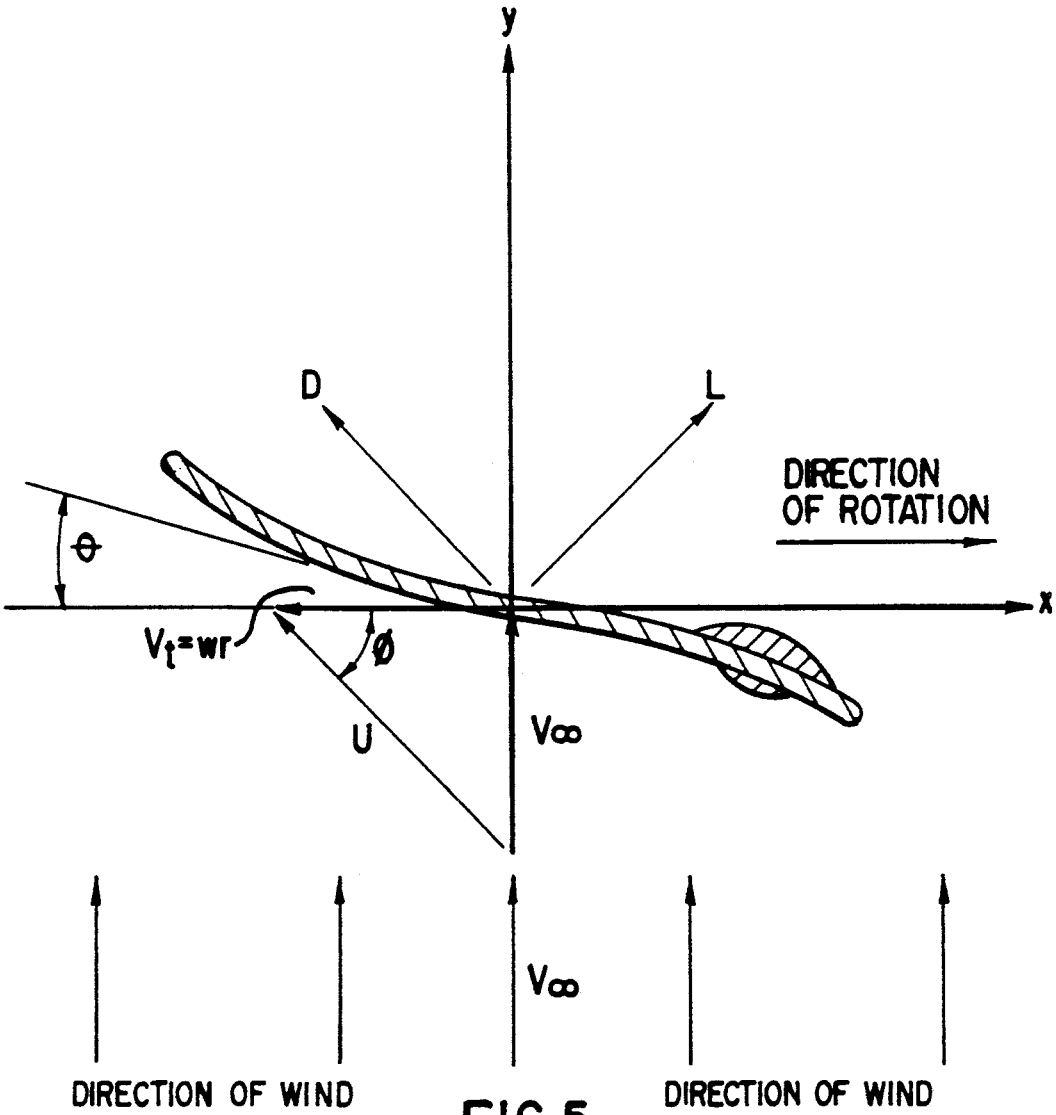
FIG. 5 is a sectional view of the flexible wing.

As shown in FIG. 5, flexible wing 9 has an effective cant angle, $\theta$, with respect to the plane of rotation called the pitch angle. This pitch angle induces the flexible wing to autorotate or windmill as it descends. FIG. 5 shows the aerodynamic forces acting on a blade element. The total velocity, U, at a blade element (relative to the blade element), is made up of two components: the tangential velocity $V_t = wr$ ( where w is the angular velocity of the element about the hub and r is the distance the element is from the hub) and the inflow velocity, V. The drag force, D, is in the direction of the velocity vector, U, and the lift force, L, is perpendicular to the drag force. Both these forces are applied at the center of pressure of the element. Components of the lift and drag forces (which are a function of the inflow angle, $\phi$) resolved in the X-direction tend to cause the blade to rotate and components resolved in the Y-direction act to retard the body from falling. The pitch angle of the blade changes with distance from hub 88. The changing pitch angle give flexible wing 9 a twist-like shape. At hub 88 of the flexible wing 9 where shaft 30 is attached, the pitch angle is small, i.e., approximately zero. Proceeding from the hub toward the tip of flexible wing 9, the pitch angle increases in a non-linear fashion. However, this angle may only be increased up to some critical point, beyond which the efficiency of the device decreases and eventually the flexible wing collapses. The pitch angle, $\theta$, and the inflow angle, $\phi$, are dependent upon the shape of the flexible wing.

The shape of flexible wing 9 depends upon the stiffness of the fabric from which it is made. If the fabric is of a dense weave or if the fabric is impregnated or coated in some fashion, flexible wing 9 is stiffer and has a lesser tendency to twist under the same dynamic pressure (all other parameters being equal).

The shape of flexible wing 9 additionally depends upon fabric thickness. A thicker fabric is stiffer and correspondingly has a lesser tendency to deform than a thinner fabric. However, increasing the thickness of the fabric also increases the weight and volume of flexible wing 9 which are undesirable because of the storage and range requirements.

While the flexible wing 9 is descending, submunition 10 creates a disturbance in the air or a wake. Increasing the span or overall length of flexible wing 9 tends to make flexible wing 9 more stable because additional wing area is outside the wake of the submunition body. As previously described, the pitch angle of flexible wing 9 is not constant throughout the span of flexible wing 9 with the angle near shaft 30 being small or zero. Lengthening the flexible wing's span without changing fabric stiffness or any other factor, however, could cause flexible wing 9 to collapse. An increase in its span also increases the flexwing's total weight and volume which results in the above mentioned problems.

The width of flexible wing's blades 7 is important. Although the are outside the body wake of the submunition is important to stability, the width of material on the inner area carries centrifugal loads imposed by the spinning tip mass and limits the pitch angle, $\theta$.

Figure 1:
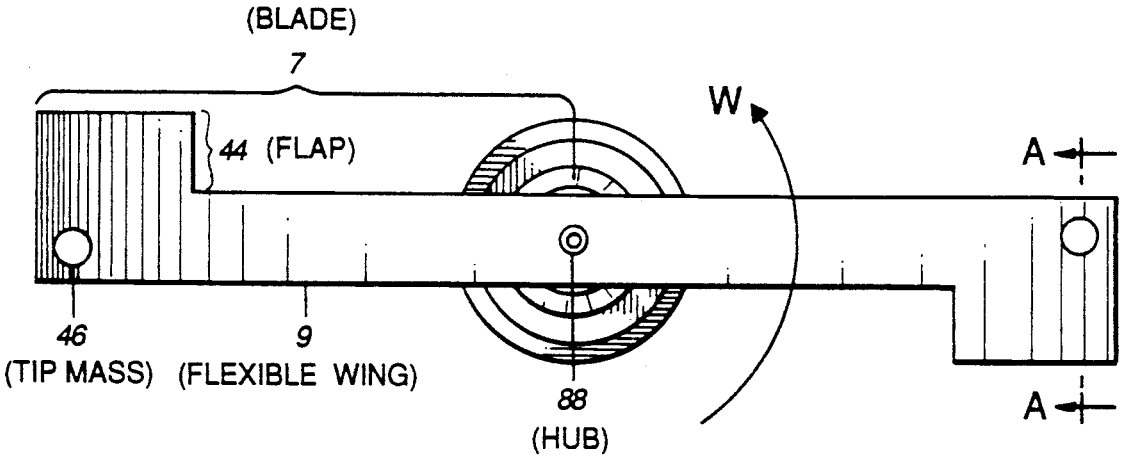
FIG. 1 is a top view of the flexible wing attached to a submunition.
Figure 3:
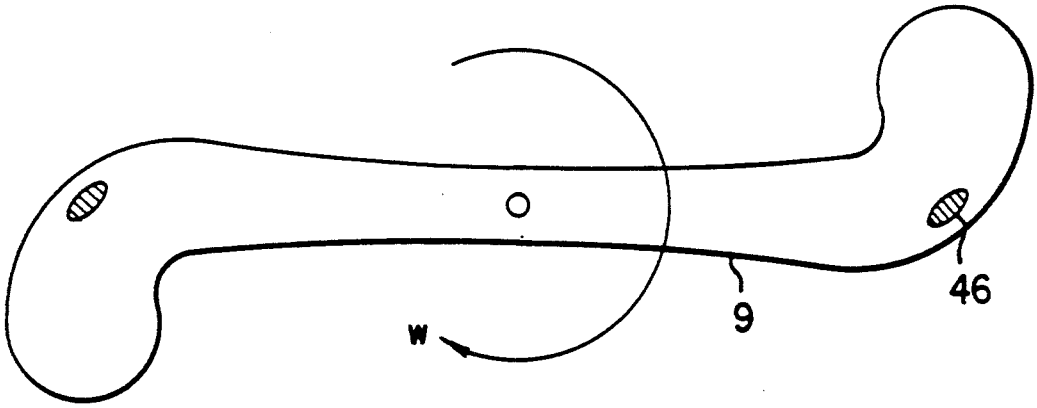
FIG. 3 is another embodiment of the invention.

The contour or flat pattern shape of the flexible wing's blades 7 need not be substantially rectangular as shown in FIG. 1. They could be of a curved nature, as shown in FIG. 3.

Figure 6:
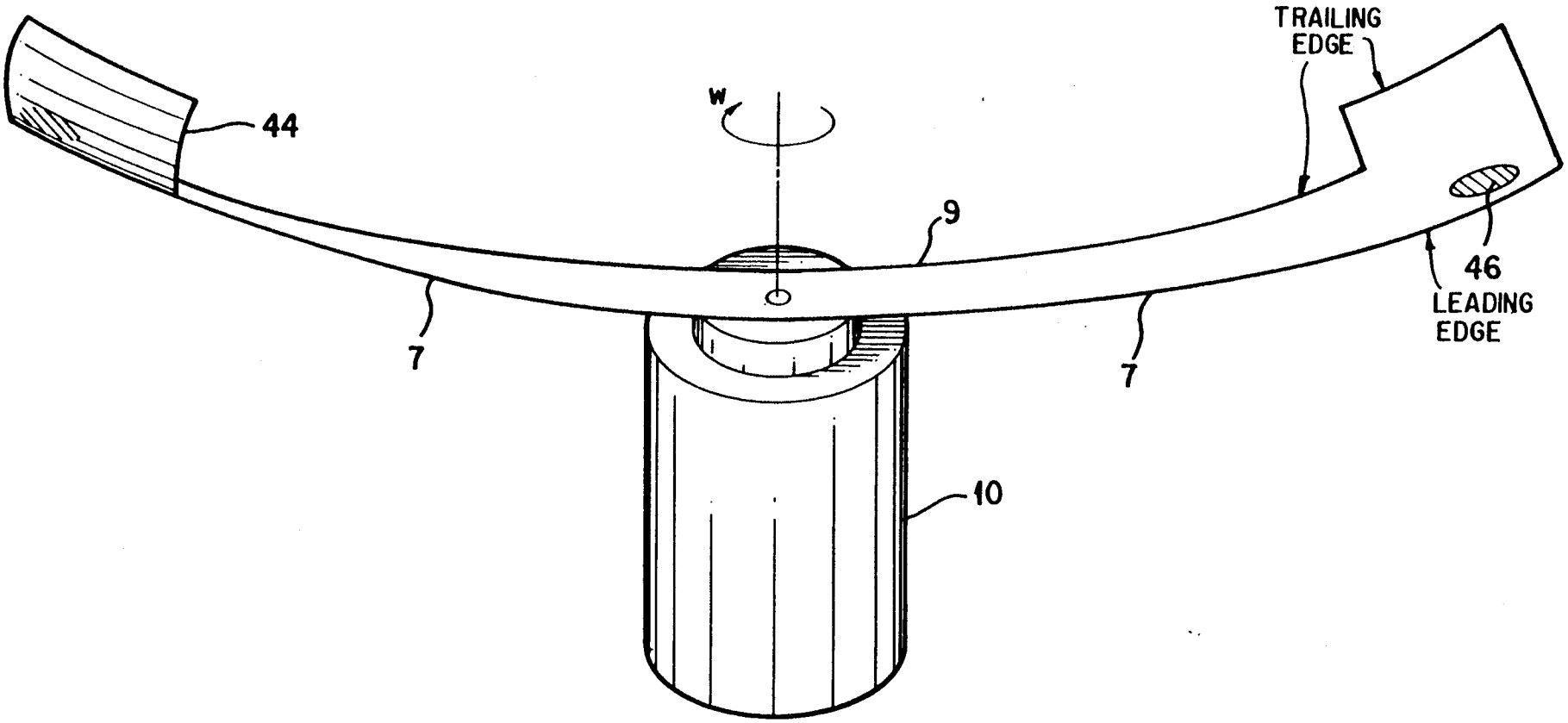
FIG. 6 is a perspective view of the flexible wing.

As shown in FIGS. 1 and 6, the size of the mass of tip weight 46, which is located on the leading edge of each end of flexible wing 9, is important in determining the shape of flexible wing 9. Tip weight 46 also aids in deploying flexible wing 9. The tip weight 46 prevents the blades from entangling during deployment. During deployment, the centrifugal force on tip weight 46 allows the tip of the flexible wing to be fed progressively radially outward away from shaft 30 of the submunition until fully deployed.

The flaps 44 of the flexible wing allow additional blade area to be exposed to the freestream airflow that is located outside the wake of the submunition body. Widening flaps 44 in a direction normal to the span of flexible wing allows for additional area in the flow region. However, flaps 44 cannot be widened indefinitely because flaps 44, without stiffening, could curl upward under dynamic pressure and provide no additional stability influence. Lengthening flaps 44 in the spanwise direction of flexible wing 9 potentially increases the area of the flexible wing and increases the stability of the flexible wing, if flap 44 is outside the wake of the submunition body. The length of flap 44 also influences the amount of twist and the distribution of the pitch angle along the span of flexible wing 9. A shorter flap 44 provides a sharp local twist, i.e., local to the areas of flap 44. A longer flap 44 provides a smaller cant along the entire length of the flexible wing.

It should be noted that the above description and the accompanying drawings are merely illustrative of the application of the principles of the present invention and are not limiting. Numerous other arrangements which embody the principles of the invention and which fall within its spirit and scope ma be readily devised by those skilled in the art.

We claim:

1. A munition system comprising:

at least one submunition system including;

a flexible fabric wing having two opposing blades for delivering the at least one submunition system in substantially a vertical direction, and for supplying toque, each of said blades having a flap at a trailing outer edge and having a weight at a leading outer edge, said flaps pointed in an opposed direction relative to said wing, a warhead means for imparting an explosion, a submunition body for housing said warhead means, an alternator means, located in said submunition body, operatively connected to said flexible wing, and an electronic fuze for electronically arming said at least one submunition system, located in said submunition body, operatively connected between said alternator and said warhead, said alternator and said wing operatively producing electric power for said fuze by rotation of said blades, whereby each of said blades of said flexible wing forming a swept configuration functionally producing a low drag and a low polar moment of inertia during a first predetermined period of time after launch and during high deployment velocities, and each of said blades of aid wing extend to a near perpendicular orientation relative to a submunition spin axis producing a high polar moment of inertia configuration in shape during a second subsequent predetermined period of time after launch.

2. A munition system of claim 1 having a carrier including a plurality of separate submunition systems.

* * * * *